United States Patent [19]

Webb et al.

[11] 4,050,566

[45] Sept. 27, 1977

[54] MECHANICAL CODE CONVERTER FOR USE WITH A TYPEWRITER OR THE LIKE

[75] Inventors: William E. Webb, Hoffman Estates; Stephan J. Ehas, Chicago, both of Ill.

[73] Assignee: Hamilton Communications, Inc., Schaumburg, Ill.

[21] Appl. No.: 632,930

[22] Filed: Nov. 18, 1975

[51] Int. Cl.[2] ..... B41J 5/30

[52] U.S. Cl. ..... 197/19; 178/17 C

[58] Field of Search ..... 197/12–14, 197/16, 17, 18, 19, 20; 178/33 R, 89

[56] References Cited

U.S. PATENT DOCUMENTS

| | | | |
|---|---|---|---|
| 2,255,011 | 9/1941 | Lake et al. | 197/20 |
| 2,396,230 | 3/1946 | Blodgett | 178/33 R |
| 2,938,952 | 5/1960 | Roggenstein | 178/17 C |
| 3,340,987 | 9/1967 | Bastian | 197/20 |
| 3,837,458 | 9/1974 | Bretti et al. | 197/19 |

*Primary Examiner*—Edgar S. Burr
*Assistant Examiner*—Paul T. Sewell
*Attorney, Agent, or Firm*—Fitch, Even, Tabin & Luedeka

[57] ABSTRACT

Apparatus is disclosed for use with typewriters of the type having trip hammers and is adapted to receive combinations of electrical signals which uniquely define the respective characteristics and to decode the electrical signals to selectively activate the trip hammers of the typewriter. The apparatus has a number of coded plates located adjacent one another in general alignment, with each of the plates having a number of transverse slots at one edge thereof at predetermined positions. Lateral or longitudinal movement of the elongated plates between first and second positions in response to receiving appropriate electrical signals causes the slots to be either into or out of alignment with an activating member which effects triggering of the trip hammer of the typewriter. Any one of the coded plates having a slot in a nonaligned orientation will prevent activation of the particular hammer. Thus, unique coded combinations of signals will selectively activate the proper trip hammer and thereby enable the proper character to be typed by the typewriter.

12 Claims, 6 Drawing Figures

MECHANICAL CODE CONVERTER FOR USE WITH A TYPEWRITER OR THE LIKE

The present invention generally relates to converting electrical information to mechanical information and, more specifically, to an apparatus for decoding combinations of electrical signals to effect actuation of the appropriate hammer of a typewriter or the like.

While the commercial use of TWX, telegram, facsimile and other types of terminal systems for transmitting information between separate geographical locations have been used for some time, computer printer terminals and other sophisticated equipment which utilizes telecommunication systems for the basic communication link continues to attract the attention of many individuals and companies, as is evidenced by the ever increasing numbers of competing products in the market place.

However, most of the systems currently in use, such as TWX, telegram, facsimile and computer printer terminals typically suffer from one or more of the disadvantages of extremely high equipment purchase or rental cost, lack of portability due to the large bulk or heavy weight characteristics, undesirably low speed of printout, and high cost of processing the information into useable form for transmission. Moreover, many of the terminal machines that are used to transmit as well as receive the printed information are only adapted for this singular use and cannot be otherwise used as a regular office typewriter. Thus, such systems typically occupy space in an office when they are not being utilized for transmitting or receiving information and can therefore be relatively inefficient in many applications.

While the advantages of rapid transmission of information with its attendant lower telephone charges may economically justify the purchase or rental of high cost, sophisticated high speed equipment, it is quite apparent that low cost apparatus that would achieve high speed exchange of such information would be quite desirable.

Thus, any company or organization having a number of remote offices which require the transmission of priority information such as, for example, data flow in and out of a home office or processing center, which must transmit or receive information for immediate processing of such items as sales orders, invoices, purchase orders, inventory reports, production schedules, business reports and other critical news would desire a system that could transmit and receive such information at a significantly lower cost.

Moreover, in the event the local or remote office is relatively small or temporary and it is desired that overhead costs and the amount of equipment be kept to a minimum, apparatus that can transmit and receive written information and also function as a standard office typewriter is highly desirable and practical.

Accordingly, it is a primary object of the present invention to provide an improved apparatus for use with a typewriter in a transmission system for sending and receiving information over a telecommunication system or the like.

Other objects and advantages of the present invention will become apparent upon reading the following detailed description, in conjunction with the attached drawings, in which.

Figure 1:
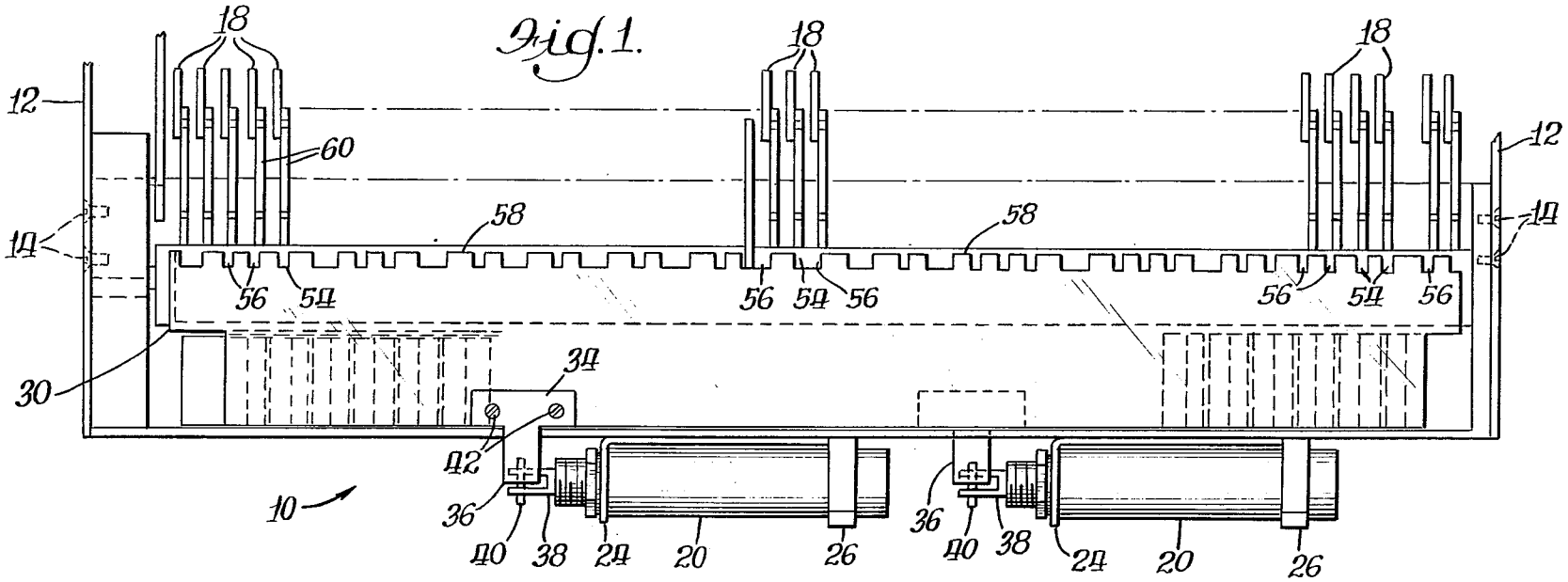
FIG. 1 is a top plan view of apparatus embodying the present invention and is shown in conjunction with a portion of a typewriter to which it is attached, the illustrated apparatus being located generally beneath the keyboard of the typewriter.

Broadly stated, the apparatus embodying the present invention is adapted for use with an electric typewriter of the type which has characters located on individual hammers which are pivoted toward the platen in response to being activated. It is primarily intended for use with a standard electric typewriter rather than a manual typewriter or a typewriter having a single ball with characters thereon that is angularly and rotatably positioned for striking the appropriate character. The apparatus of the present invention is used to actuate the trip hammer having the appropriate character thereon in response to receiving a combination of electrical signals that uniquely define the character which is to be struck or typed.

The apparatus forms an integral part of and is installed in a typewriter and, in combination with electrical circuitry, adapts the typewriter to receive combinations of electrical signals which are uniquely coded to identify the character to be struck. The apparatus decodes the electrical signal information and actuates the trip mechanism of the appropriate character which is identified. It should be understood that the keyboard of the typewriter does not have its individual keys mechanically linked to the trip mechanisms of the typewriter but that the depressing of individual keys generates electrical signals which define the character identified by the key and that the apparatus embodying the present invention decodes the electrical signal information and actuates the appropriate hammer or power arm.

From this very general description, it should be understood that the typewriter having the apparatus of the present invention installed therein will be operable to type information regardless of whether it originates at the typewriter keyboard or in the form of electrical signals that are received over telephone lines or other transmission from a remote geographical location. It should therefore be apparent that the typewriter can be used as a typewriter, i.e., it can be used to perform the routine typing tasks that are necessary in an office and, when it is operated in the receive mode in the transmission system, it functions as a remote terminal and can provide a printout of the received information.

Conversely, it should also be recognized that when the typewriter is being used as a typewriter, it generates electrical signals that can be stored on a magnetic tape or the like by appropriate equipment while it is simultaneously typing the characters. The message is thereby stored on magnetic tape and can be transmitted to another location in the same manner as has been heretofore described.

More specifically, with respect to the encoding portion of the typewriter which is not a part of the present invention, the plurality of keyboard switches each generate electrical signals that identify a particular key or functional operation, such as "shift", "space" and the like when the appropriate key or bar is depressed. By connecting the switches of the keyboard in electrical circuits that are matrixed and connected to decoding circuitry, the striking or depressing of the individual key switches will generate signals that uniquely identify the depressed key and these signals are connected to a mechanical decoding apparatus which embodies the present invention.

With a transmission system as described, it should be realized that a typewriter having the encoder, the electric keyboard and the associated matrixing circuitry can be used with a separate conventional magnetic tape recorder, for example, for transmitting the recorded message to another remote location. Also, storage devices other than a magnetic tape recorder and other equipment such as accoustic couplers, modems and the like that are used for transmission and receipt of coded information over telephone systems and the like may be necessary for a complete system. Thus, the different types of operation that can be performed in a two-way data transmission system is at least partially a function of the particular peripheral equipment that is utilized, with the apparatus embodying the present invention forming an integral part of the operation of virtually any two-way transmission system.

Figure 2:
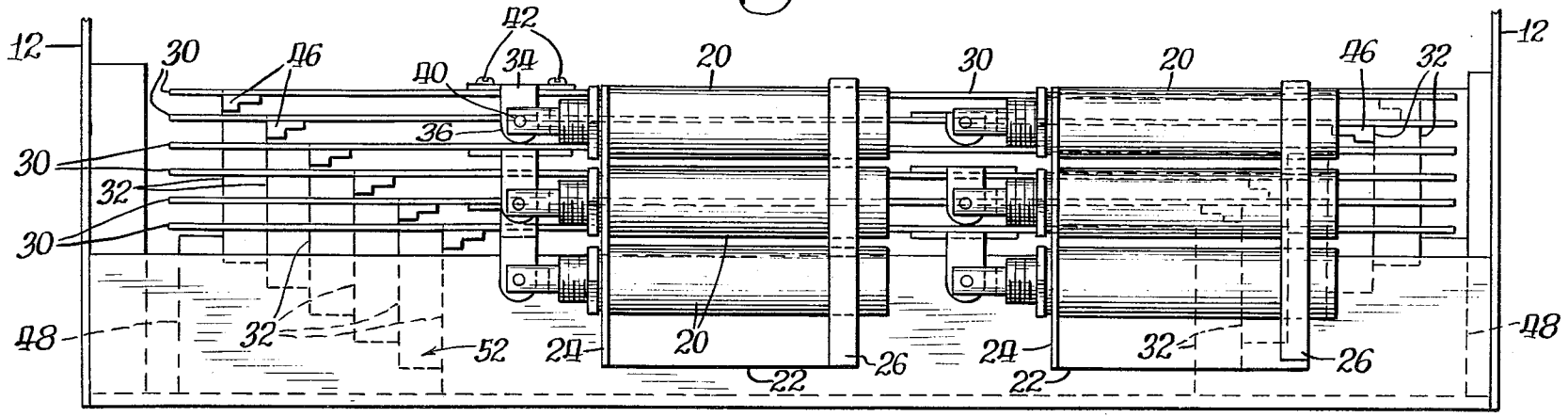
FIG. 2 is a front plan view of the apparatus shown in FIG. 1.
Figure 3:
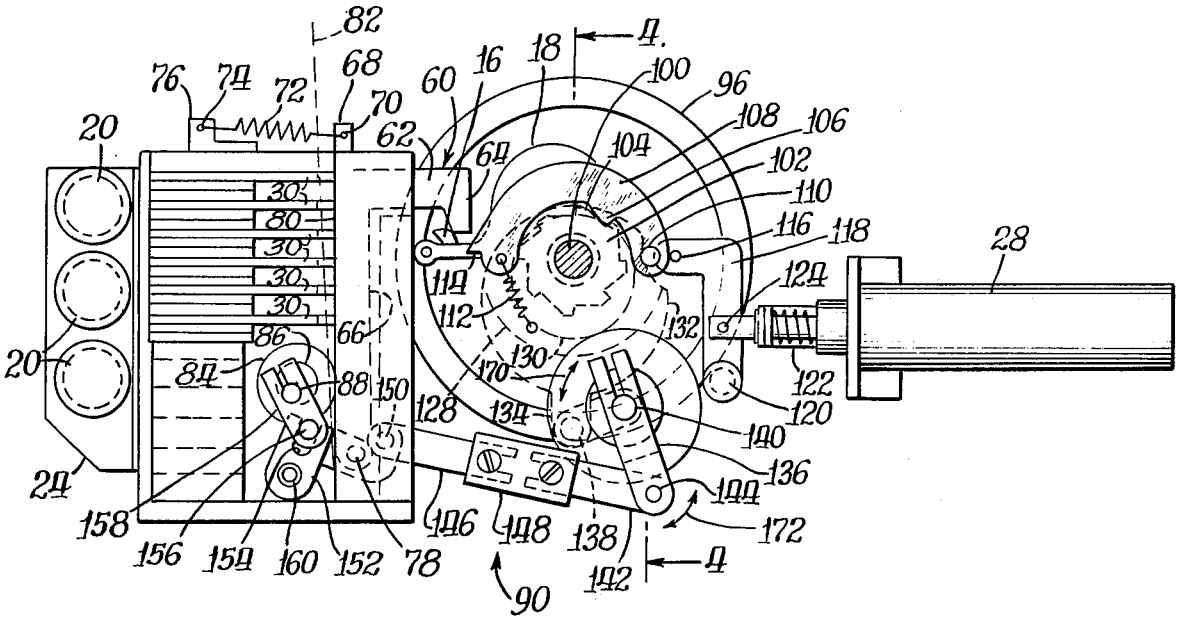
FIG. 3 is an end view of the apparatus shown in FIGS. 1 and 2, with portions removed and partially in section.

Turning now to the drawings and particularly FIGS. 1 and 2, the decoding apparatus, indicated generally at 10, embodying the present invention is shown together with portions of a typewriter having side frame members 12 to which the apparatus 10 is attached by a number of screws 14 or the like. Portions of the typewriter trip hammer mechanism and particularly trip members 16 are shown adjacent extensions 18 of the power arms as is best illustrated in FIG. 3. When the trip member 16 is moved downwardly, the hammer containing a character thereon is brought into engagement with a rotating rod (not shown) which throws the hammer upwardly to print the character that is carried by that hammer. Thus, by actuating any of the trip members 16, the hammer associated with that particular member will be operated. As is shown in FIGS. 1 and 3, each of the power arm extensions 18 are spaced along the width of the typewriter and a separate actuating mechanism comprising a part of the apparatus of the present invention is provided for each of the hammers of the typewriter so that the individual typewriter hammers may be selectively operated. To actuate a trip member 16 and cause its associated hammer to strike the platen, a series of events occur which ultimately results in the appropriate hammer being actuated. Broadly stated, there is an actuating means associated with each of the trip members 16 which causes it to be moved downwardly if electrical signals are received and applied to a number of solenoids which are mechanically linked to respective coded plates. The plates collectively operate to permit the actuating means to move the trip member 16 if the electrical signals received and applied to energize the solenoids uniquely define the particular hammer.

More particularly, and referring to FIGS. 1-3, there are preferably a total of six electrical solenoids 20 that are appropriately mounted on mounting brackets 22 which have a right angled extension 24 with apertures therein adapted to receive the solenoids. Another clamping member 26 is provided to hold the opposite end of the solenoids. In addition to the solenoids 20 which are operable to control the position of the coded plates, another solenoid 28 may be provided for controlling the operation of a clutch mechanism which will be hereinafter described. The solenoids 20 are operated by the electrical signals from appropriate circuitry with the signals preferably being generally simultaneously applied and with sufficient duration to be compatable with the mechanical response time of the apparatus. By using a binary coded signal, i.e., the energizing and deenergizing of a solenoid 20 respectively representing logical "0" and logical "1" conditions, for example, six of the solenoids can define 64 combinations which will easily include all of the integers, the letters of the alphabet and many other functions and symbols, such as are defined by the American Standard Code for Information Interchange, often referred to as ASCII code. Thus, a six bit word transmitted to the corresponding solenoids will uniquely define all of the information necessary for the typewriter to provide a typed printout of a single character.

The solenoids are utilized in a manner whereby they are normally in their rest or unenergized condition and are energized only for a short time necessary to effect typing of a character or performing a function. In other words, when electrical signals are not being received, it is preferred that no energization of the solenoids occur. In this regard, the transmission of a six bit word initially causes the clutch solenoid 28 to be energized which sets in motion a series of events which permits the typewriter to type a character or perform a function such as "space", "tab", "shift"or the like. After the character has been typed, the mechanism is automatically reset so that a subsequent six bit word may be received which will be decoded to cause another character or function to be typed or carried out. In the event that a tape is being played through the typewriter which produces very rapid typing, i.e., on the order of more than 100 words per minute, the solenoid 28 may be continually energized during such operation. However, in the event that a typist is typing on the typewriter, the much slower operation may cause the solenoid 28 to be energized prior to each character being typed. In this regard, the solenoid 28 merely causes the clutch mechanism to be engaged in a manner that will be hereinafter described in detail. From the foregoing, it should be understood that the receipt of a six bit word will cause the solenoids 20 as well as the solenoid 28 to be energized until one of the hammers is activated or a function is carried out, whereupon the solenoids are de-energized and the mechanism is reset for subsequent receipt of another six bit word identifying another character or function. The above described mode of operation maximizes the effective useful life of the solenoids and also conserves energy during operation. It should also be understood that the typewriter having the apparatus embodying the present invention installed therein may correctly be described as a portable device since it is generally the same size as a quality portable electric typewriter. The apparatus of the present invention does not appreciably add to the overall size and weight of the typewriter. In this regard, the solenoids are preferably 115 vdc, 4 watt continuous duty solenoids with 4 ounces of pull on the plunger, such as Model T4 X 16 as manufactured by the Guardian Electric Manufacturing Co. As is best shown in FIGS. 1 and 2, there are a total of six coded plates 30 generally aligned but spaced apart from one another in the vertical direction and mounted for lateral or horizontal movement in response to actuation of the respective solenoids 20. Each of the coded plates extends substantially the full width of the keyboard and is supported in the positions shown by a pair of relatively thin, flexible support plates 32 located on opposite ends thereof, with all of the support plates being similarly mounted. The flexibility of the support plates 32 is necessary to permit the movement of the coded plates 30 in the horizontal direction to correctly position slots located in them relative to the actuating members associated with the individual hammer mechanisms.

Figure 6:
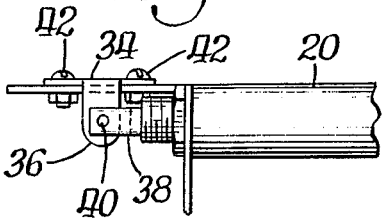
FIG. 6 is also an enlarged view of a portion of the apparatus shown in FIG. 2.

As shown in FIGS. 2 and 6, each of the coded plates 30 is operably connected to one of the solenoids 20 by a bracket 34 having a right angled extension 36 that is coupled to a plunger 38 of the solenoid 20 by a key or pin 40 or the like. Each of the brackets 34 is connected to its respective coded plate by means of nuts and bolts 42 or similar means. When the solenoid 20 is actuated, it will cause the plunger 38 to retract and move the coded plate 30 to the right as shown in FIGS. 1 and 2 by a predetermined amount, which is preferably on the order of about 1/16 of an inch. Conversely, when the solenoid is de-energized, the plunger 38 and coded plate will move back to their normal leftward rest positions shown in the drawings.

Figure 5:
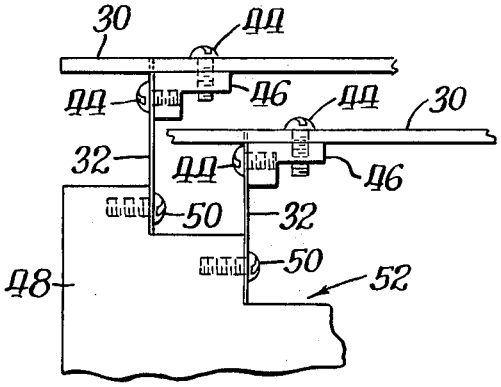
FIG. 5 is an enlarged view of a portion of the apparatus shown in FIG. 2.

As is illustrated in the enlarged more detailed view of FIG. 5, the support plates 32 are mounted to the coded plates 30 by two screws 44 which clamp the coded plate 30 and support plate 32 to a right angled mounting bracket 46 having apertures therein for receiving the screws 44. The lower ends of the support plates 32 are similarly attached to the mounting block 48 by screws 50. As is best shown in FIGS. 2 and 5, the support plates 32 preferably have the same vertical length so that deflection of each support plate will be substantially the same with the same amount of force applied to move the coded plates 30 to the right, all of which contributes to the reliable, uniform action of the apparatus. The mounting block 48 accordingly has a number of steps 52 therein, the vertical portions of which provide a surface against which the screws can hold the lower end of the support plates 32. The support plates are preferably made of spring steel having a thickness of about 0.006 inch, a width of about ⅝ inch and a length of about 1.25 inches, although other sized support plates could be used, provided that they are compatable with the strength of the solenoids that are used to power them and have sufficient resiliency to return the coded plates to their normal rest position in sufficiently short time to provide reliable operation at the speeds that are contemplated, i.e., at least about 600 characters per minute. It should also be understood that an alternative support arrangement for the coded plates may be utilized, i.e., a pair of hinges may be provided on opposite ends of the support plate with a spring biasing the coded plate to the rest position shown in FIGS. 2 and 5. If a hinge arrangement is used, a stop member or the like to hold the coded plates from travelling beyond the leftward normal rest position may be necessary. It should also be apparent that a hinge arrangement would obviate the necessity for a resilient support member 32, since its resiliency characteristics would not be utilized.

In accordance with an important aspect of the present invention and referring to FIG. 1, each of the coded plates has a number of slots or recesses 54 and 56 located along the rearward edge 58 thereof. It should be understood that only the slots for the top coded plate 30 are shown in FIG. 1 for the sake of clarity. As previously mentioned, the typewriter has a trip member 16 which causes the hammer to be propelled toward the platen when it is tripped and the power arm extension 18 comprises a portion of the mechanism for each key. Referring to FIG. 1, each of the power arm extensions 18 is shown adjacent an actuating lever 60 which is a part of the apparatus of the present invention and which is operable to actuate the trip member. In other words, when the proper electrical signals are decoded, one of the actuating levers 60 will be moved to engage a trip member and cause the hammer to type the appropriate character. The trip actuating levers 60 are uniformly spaced along the width of the keyboard and are either aligned with slots of the coded plate 30 or are out of alignment therewith. In the rest position shown in FIGS. 1 and 2, the slots 54 are shown to be aligned with the actuating levers 60, while the slots 56 are out of alignment. With the coded plate in the illustrated rest position, an actuating lever 60 is capable of entering a slot 54 while not sufficiently aligned to be able to enter a slot 56. However, when the coded plate is moved to the right in response to energization of its interconnected solenoid, the plate will be moved to the right the approximately 1/16 inch and the slots 56 will be aligned with the actuating members 60, while the slots 54 will no longer be aligned. In this manner, the ability of an actuating lever 60 to enter or not enter its associated slot depends upon the position of the slot relative to the lever when the coded plate is in the rest position as well as whether the plate has itself been moved from the rest position. A binary indication can thereby be provided by using the electrical signal to actuate one of the solenoids and either move a normally nonaligned slot into alignment or move a normally aligned slot out of alignment, with the rest position of a coded plate representing a binary "0" and the moved rightward position caused by actuating the interconnected solenoid the binary "1" indication. In other words, by appropriately positioning the slots in one of the two positions, either directly in line with an actuating lever 60 as is the case with the slots 54 or 1/16 of an inch to the left thereof as is the case with the slots 56, the particular hammer of a typewriter can be uniquely defined or coded. By coding the other five of the coded plates 30, six bits of binary information can be used to identify the proper hammer that is to be activated.

Turning now to FIG. 3, the actuating lever indicated generally at 60 is shown to have a generally horizontal portion 62 with a downward extension 64 that is positioned to engage the trip member 16 associated with each hammer. The actuating lever 60 also has a generally vertical portion 66 with a upwardly directed extension 68 positioned and a small aperture 70 adapted to receive one end of a spring 72 that has its opposite end secured to a rod 74 that is mounted in a bracket 76 at opposite ends. The actuating lever 60 pivots around a shaft 78 or the like so that its rearward vertical surface 80 is adapted to enter the slots 54 or 56 in the event the slots for the particular actuating lever 60 are aligned in each of the six coded plates 30, whereupon the spring 72 will urge the actuating lever to the left, i.e., rotated counterclockwise around the shaft 78 to the position illustrated by the dotted line 82. When the actuating lever is moved so that the rearward surface 80 enters a slot in each of the six coded plates 30, the extension 64 of the actuating lever will trip the trip member 16 and cause the particular hammer to be activated. From the foregoing it should be understood that improper alignment of the slot in any one of the coded plates 30 will prohibit the leftward movement of the actuating member 60 and not cause the trip member to be tripped. Thus, by using the six bits of information, only one hammer will be activated by the apparatus of the present invention. After the hammer has been activated, the mechanism is reset and all of the coded plates are returned to their normal rest positions shown in FIGS. 1 and 2 until another six bit word is received and decoded by the solenoids moving (or not moving) the coded plates into the appropriate positions.

To reset the apparatus after a trip member has been tripped by an actuating lever, it is necessary to move the actuating lever 60 back to its normal position shown in FIG. 3 from the position where it is located within the slots represented by the dotted line 82. To move the actuating lever to the right to the position shown in FIG. 3, an eccentrically mounted roller 84 is provided, it being rotatably journaled around a smaller rod 86 by means of a ball bearing at each end (not shown) or the like. The rod 86 is also connected to a yet smaller shaft 88 which is suitably journaled for rotation. Thus, the roller 84 and the rod 86 pivot around the smaller rod 88 which is offset from the center of the roller, so that rotation thereof will cause the outer surface of the roller 84 to engage the edges 80 of all of the actuating levers 60 and move them to the right when the roller is moved in a clockwise direction or permit the actuating lever to be moved to the left when the roller 84 is moved in a counterclockwise direction. By suitably rotating the shaft 88 between first and second arcuate positions, the roller 84 will alternatively permit leftward movement of one of the actuating levers and thereafter reset it to its normal rest position shown to the right.

In accordance with another aspect of the present invention, a drive mechanism is provided for rotating the shaft 88 at a predetermined speed that is compatible with the frequency of six bit words that are received. Broadly stated, a clutch mechanism actuated by the clutch solenoid 28 drives a linkage, indicated generally at 90 in FIG. 3, which causes the roller 84 to be alternately rotated in opposite directions to permit one of the actuating levers to enter the slots of the coded plates and thereafter move the actuating lever back into its normal position.

Figure 4:
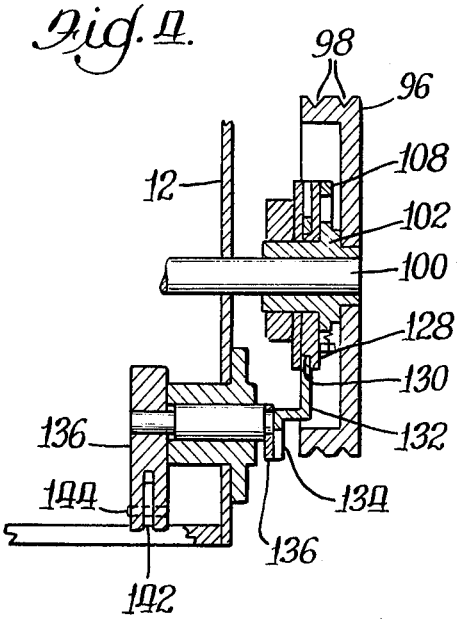
FIG. 4 is a cross section of the apparatus embodying the present invention and is taken generally along the line 4—4 of FIG. 3.

Referring to FIGS. 3 and 4, the clutch mechanism is operably associated with the motor and drive shaft of the typewriter itself. More specifically, the electric motor (not shown) of the typewriter drives a pulley 96 by means of a pair of belts (not shown) which are carried by grooves 98 in the outer circumference of the pulley 96. The pulley 96 is mounted upon a clutch sprocket 102 which is mounted upon shaft 100, both of which are continuously driven at about 600 rpm. The clutch sprocket 102 has sprocket teeth 104 for engaging a tooth 106 of a clutch latch 108 that pivots around pin 110. The opposite end of the clutch latch is biased by a spring 112 so that the clutch latch 108 would be moved radially inwardly toward the shaft 100 so as to mesh the teeth 104 and 106. However, the clutch latch 108 is normally held away from the sprocket 102 so that the teeth 104 and 106 do not engage one another unless the clutch mechanism is actuated by energizing the solenoid 28. The clutch latch is held away from the sprocket by an outward extension or tooth 114 which engages a pin 116 located on an angled lever 118 that is mounted for pivotal movement around a pin 120 and which is attached to a plunger 122 of the solenoid 28 by means of a pin 124 or the like. While the extension 114 of the clutch latch 108 is shown on the opposite side of the shaft 100 in FIG. 3, the extension 114 will generally engage the pin 116 and hold the clutch latch 108 in a stationary position until the solenoid 28 is actuated which causes its plunger 122 to be retracted and move the pin 116 to the right out of engagement with the extension 114. When this occurs, the spring 112 will pull the clutch latch 108 inwardly toward the shaft 100 and engage the tooth 106 with one of the sprocket teeth 104 and the clutch latch 108 will rotate with the sprocket 102. It should also be pointed out that the pin 110 and the spring 112 are mounted upon an eccentric member 128 which has a smaller offcentered raised circular portion 130 on which an eccentric follower 132 rides. The lower portion of the follower 132 has an extension 134 which is attached to a bell crank 136 by a pin 138 or the like. The bell crank 136 pivots around the pin 140 and has its lower end portion connected to a link 142 by pin 144.

To complete the linkage 90, the link 142 is connected to a similar link 146 by a link adjuster 148 that permits adjustment of the effective length of the combined links 142 and 146, and the link 146 is connected by pin 150 to a swing lever 152 that is generally of a right angle shape. The swing lever 152 has a slot 154 in the upper portion thereof in which a pin 156 of a roll arm 158 that is attached to the previously described shaft 88. The swing lever 152 is pivoted around a pin 160 so that as the linkage 90 reciprocates, the swing arm 152 alternately rotates counterclockwise and clockwise around the pin 160 and causes the rod 88 to be similarly alternately rotated.

While the above described linkage between the clutch and the roller 84 that resets the apparatus comprises a number of parts, the operation is relatively simple and is substantially as follows. When the clutch is engaged by actuating the solenoid 28, the clutch latch meshes with the sprocket and causes the eccentric to rotate the follower 128 so that the lower extension 134 thereof will move vertically as shown by the arrows 170 in FIG. 3. Vertical movement of the eccentric 128 will cause the bell crank to pivot around the pin 140 causing the lower end thereof to alternately move in the direction of the arrows 172. Thus, the straight length comprising the links 142, 146 and the link adjuster 148 therebetween will alternately move to the left and right and cause the swing lever 152 to pivot around the pin 160 in clockwise and counterclockwise directions and thereby cause the rod 88 to be alternately rotated in a clockwise and counterclockwise direction. As long as the solenoid 28 is actuated, the clutch will be engaged and the linkage will move the shaft 88 at the same frequency as the speed of the shaft 100 and pulley 96. Once the clutch solenoid 28 is deenergized, the arm 188 will move to the left causing the pin 116 to engage the outward extension 114 of the clutch latch and move the same so that it will be disengaged from the sprocket 102.

In the event that the typewriter is being driven by a recorded message at a speed of 125 words per minute, for example, the solenoid 28 will not have sufficient time to be de-energized and the clutch mechanism will be engaged so that the linkage 90 will be generally continuously operating. In this regard, it is contemplated that a synchronous switching device such as a strobe light or other light circuit such as a phototransistor and light emitting diode arrangement may be used to synchronize the decoding solenoids 20, rather than utilizing the clutch operating solenoid 28. In such an arrangement, a clutch mechanism would not be required and the linkage 90 would be continuously operating in the described manner. In this regard, it is noted that when a six bit word is received, the solenoid 28 is first actuated prior to actuating the solenoids 20 so that the roll 84 is moved to the left, in effect permitting one of the actuating levers 60 to be moved to the left so as to trip a trip member 16 of the typewriter and cause the hammer to strike the platen. After this occurs, the roller 84 will be moved to the right, urging the actuating lever to the right, thereby resetting the apparatus so that another six bit word can be received.

From the foregoing description, it is apparent that the apparatus embodying the present invention is of unique design and is compact and adapted for installation in electric typewriters of the type that have separate hammers carrying the type characters and that the typewriter having the described apparatus installed is useful as a typewriter in addition to functioning as a remote terminal in a system that can send and receive written information over telephone lines or the like. The compact design of the apparatus does not appreciably affect the overall size and weight and therefore does not detrimentally affect the portability of the typewriter. Nor does it otherwise interfere with the normal operation of the typewriter. The apparatus can be inexpensively produced compared to many existing devices being marketed and represents a significant advance in the art.

Although preferred embodiments of the present invention have been illustrated and described, various modifications thereof will become apparent to those skilled in the art and, accordingly, the scope of the present invention should be defined only by the appended claims and equivalents thereof.

Various features of the invention are set forth in the following claims.

What is claimed is:

1. Apparatus for use with a typewriter or the like and adapted to decode unique combinations of electrical signals, the combinations identifying individual characters associated with a trip member of a particular typewriter hammer, said apparatus being adapted to actuate a particular trip member in response to receiving a combination of electrical signals identifying the same, the apparatus comprising:

a mechanism associated with each trip member and adapted to actuate the same in response to movement from a rest to an actuated position;

a plurality of aligned coded flat plates, said plates being in generally parallel planes, each of said plates having slots located along one edge of the length thereof, each said slot being in one of two positions relative to each trip member, said positions being separated from one another by a predetermined distance, said actuating mechanism for each trip member being adapted to move to said actuated position when the coded plates are selectively positioned in either a first or second position so that all of the slots in the coded plates associated with said particular trip member are in alignment, the non-alignment of any one of said associated slots being effective to preclude movement of said actuating mechanism;

at least two spaced mounting blocks to which support plates for each of said coded plates are rigidly mounted generally perpendicular to said coded plates, said support plates being fabricated of flexible material that permits generally lengthwise movement of said coded plates and also biases said coded plates in one of said first and second positions;

means associated with each of said plurality of coded plates for moving each of said plates between said first and second positions to bring the slots into and out of alignment with the actuating mechanism in response to said electrical signals, a predetermined combination of electrical signals causing said moving means to selectively move said coded plates and align the slots so that a predetermined one of said actuating mechanisms moves to said actuating positions and causes the associated trip hammer to be actuated; and, means for resetting said actuating mechanism subsequent to actuation of said associated trip member.

2. Apparatus as defined in claim 1 wherein each of said moving means comprises an electrically operable solenoid having a movable plunger connected to an associated coded slate so that selective energization of said solenoid moves said coded plate between said first and second positions.

3. Apparatus as defined in claim 1 wherein each of said mounting blocks has a number of steps therein, said support plates being attached to the vertical portions thereof, the height of the steps coinciding with the distance between adjacent coded plates and said support plates being of uniform length.

4. Apparatus as defined in claim 1 wherein each of said actuating mechanisms comprises an actuating lever adapted to be movable into one of the slots of each of said plurality of coded plates when said slots are aligned, the movement into said slots actuating the trip member of the typewriter.

5. Apparatus as defined in claim 4 wherein said actuating lever has one end portion adapted to engage said trip member, the opposite end thereof being pivotally attached so that rotation thereof will move the same into said slots when they are aligned.

6. Apparatus as defined in claim 5 wherein said actuating mechanism includes means for normally biasing said actuating lever toward said slots.

7. Apparatus as defined in claim 6 wherein said resetting means comprises an eccentrically mounted roller adapted to contact said actuating mechanism and move the same out of said slots when rotated in a predetermined direction.

8. Apparatus as defined in claim 7 including a drive pulley associated with the typewriter, a clutch mechanism operably connected to said pulley and adapted to be engaged in response to actuation thereof, linkage means interconnecting said clutch mechanism with said roller so that said resetting means is activated subsequently of said trip hammer being actuated.

9. Apparatus as defined in claim 8 including a solenoid having a moveable plunger, a linkage interconnecting said plunger and said clutch mechanism, so that energization of said solenoid engages said clutch mechansim.

10. Apparatus as defined in claim 1 including at least six of said coded plates.

11. Apparatus as defined in claim 1 wherein said predetermined distance is about 1/16th inch.

12. Apparatus for use with a typewriter or the like for decoding uniqud combinations of electrical signals, the combinations identifyig individual characters associated with a trip member of a particular typewriter hammer, said apparatus actuating a particular trip member in response to receiving a combination of electrical signals identifying the same, the apparatus comprising:

a mechanism associated with each trip member and adapted to actuate the same in response to movement from a rest to an actuated position, said actuating mechanism including a unitary actuating lever pivotable around one end portion, the opposite end portion having a generally perpendicular portion with a transverse extension located at the free end of said perpendicular portion, said extension engaging said trip member and actuating the same during pivoting of said actuating lever;

a plurality of aligned coded flat plates, said plates being in generally parallel planes, each of said plates having slots located along one edge of the length thereof, each said slot being in one of two positions relative to each trip member, said positions being separated from one another by a predetermined distance, said actuating mechanism for each trip member being adapted to move to said actuating position when the coded plates are selectively positioned in either a first or second position so that all of the slots in the coded plates associated with a particular trip member are in alignment and permitting the associated actuating lever to pivot and enter said slots and actuate said trip member, the nonalignment of any of said associated slots being effective to preclude movement of said actuating lever;

means associated with each of said plurality of coded plates for moving each of said plates between said first and second positions to bring the slots into and out of alignment with the actuating mechanism in response to said electrical signals, a predetermined combination of electrical signals causing said moving means to selectively move said coded plates and align the slots so that a predetermined one of said actuating levers of said actuating mechanism pivots to actuate the associated trip hammer; and, means for resetting the actuating mechanisms so as to pivot said actuating lever out of said slots, subsequent to actuation of said associated trip member.

* * * * *